US005766701A

United States Patent [19]

Lee

[11] Patent Number: 5,766,701

[45] Date of Patent: Jun. 16, 1998

[54] FOLDABLE MODEL

[76] Inventor: William Lee, DongguanKing Sun Metals & Plastics Manufacturing Co., Ltd.King Sun Ind.Estate, Hengjiangxia, Changping town, Dongguan City, Guangdong, China

[21] Appl. No.: 691,364

[22] Filed: Aug. 2, 1996

[30] Foreign Application Priority Data

Jul. 5, 1996 [CN] China ..... 96 2 37161.0

[51] Int. Cl.[6] ..... A63H 3/16; B44C 3/06

[52] U.S. Cl. ..... 428/9; 428/12; 446/375; 446/376; 446/487

[58] Field of Search ..... 428/8, 9, 12; 446/487, 446/375, 376; 223/66; 403/102, 321

[56] References Cited

U.S. PATENT DOCUMENTS

| | | | |
|---|---|---|---|
| 609,634 | 8/1898 | Tanner | 403/102 |
| 3,018,583 | 1/1962 | Novotney | 46/11 |
| 4,258,503 | 3/1981 | Bales | 47/41.12 |
| 4,462,606 | 7/1984 | Hon | 403/102 |
| 4,518,277 | 5/1985 | Bush et al. | 403/102 |
| 4,594,071 | 6/1986 | Zaruba et al. | 446/99 |
| 4,650,701 | 3/1987 | Jackson | 428/16 |
| 4,673,373 | 6/1987 | Herring et al. | 446/378 |
| 5,090,935 | 2/1992 | Monson | 446/101 |
| 5,225,255 | 7/1993 | Kaulfuss et al. | 428/16 |
| 5,451,436 | 9/1995 | Shelleman | 428/8 |
| 5,501,885 | 3/1996 | Yeh | 428/9 |

FOREIGN PATENT DOCUMENTS

| | | | |
|---|---|---|---|
| 2140251 | 8/1993 | China . | |
| 18798 | 10/1892 | United Kingdom | 403/102 |

*Primary Examiner*—Alexander Thomas
*Attorney, Agent, or Firm*—Finnegan, Henderson, Farabow, Garrett & Dunner, L.L.P.

[57] ABSTRACT

A foldable model made out of a number of wire materials through deformation, assembling and welding to form a main body portion and several accessory portions, characterized in that the joining of the accessory portions with the main body portion are carried out by means of hinges and pivotal fastening latches so that those portions needing to be folded can be folded into or towards said main body portion to reduce the overall packing dimension of said model. The foldable animal model according to the present invention after being folded occupies a volume much smaller than that of a prior art animal model of corresponding dimension after being dismantled and the folding process before packing and the unfolding process after transportation are very simple and easy. Therefore, the foldable model of the present invention is not only convenient for transportation but also the relevant cost thereof have evidently been reduced, so that the selling prices of various models can thus be reduced.

2 Claims, 4 Drawing Sheets

FOLDABLE MODEL

The present invention relates to a wire-frame lantern model, more particularly to foldable models made out of selected wire materials through such processes as deformation, assembling and welding.

Some parts of the current animal model made out of wire materials, when required for storage or transportation, need to be detached and rejoined by means of conventional muff couplings or piece materials. U.S. Pat. No. 5,451,436 discloses a sort of animal model which is separated into several parts, the parts can be rejoined with one another by means of such fastening elements as bolts and nuts. The above rejoining or fastening requires high processing precision, and a great number of working procedures. Since only dismantlement is proceeded for packing the model made in this way, the volume of the model after packing is still very enormous, and the process of dismantling is rather labor-consuming.

The object of the present invention is to overcome the above-mentioned defects existing in the prior arts and to provide a foldable model made out of wire materials.

To achieve the above-mentioned objects, the present invention provides a foldable model made out of wire materials, in which a main body portion and several accessory portions are constructed out of wire materials through deformations of the wire materials along with assembling and welding, and these accessory portions connected to the main body portion by means of hinges and latches, so that during packing for transportation, the latches can be removed to allow the accessory portions to be folded pivotally about respective hinge, or even into a cavity formed by the wires of the main body portion.

As compared to the prior arts, the present invention has the advantage that the volume of the foldable model after being folded is smaller than that of a corresponding prior art model after being dismantled to facilitate transportation. The unfolding during use is very convenient and easy.

BRIEF DESCRIPTION OF THE DRAWINGS

The following is a description of an embodiment of the present invention with reference to the attached drawings, in which:

As shown in FIG. 1, it shows a foldable animal model according to the present invention. The model comprises a main body portion 10 (body of the animal), accessory portions 11, 12, 13, 14 (front and rear legs of the animal), accessory portion 15 (neck and head of the animal), and an ornamental piece 16 (horns of the animal).

As shown in FIG. 2, the main body portion 10 consists of an upper part 10*a* and a lower part 10*b*, foldably linked by hinge 2. Thus, when it is being packed, the upper part 10*a* can be lifted open about the hinge, and a certain accessory portion (in this embodiment of the present invention, it is neck and the head of the animal model) can be folded into the lower part 10*b*. Then the upper part 10*a* pivot back to its initial position and the upper part 10*a* is secured to the lower part 10*b* by means of a self-locking hinge 1.

As shown in FIG. 3, the accessory portion 11 (rear legs of the animal) and the main body portion 10 are in an exploded state. The main body portion 10 and the accessory portion 11 can be foldably joined together by means of the pivotal hinge 2, and fixed by a pivotal fastening latch 3. When being packed, the accessory portion 11 can be folded towards the main body portion 10, after the pivotal fastening latch 3 pivots off.

As shown in FIG. 4, after the upper part 10*a* of the main body portion 10 is lifted open, the accessory portion 15 can be folded pivotally about hinge 4 towards the hollow cavity formed by the wires of the lower part 10*b* of the main body portion 10.

The accessory ornamental piece 16 such as horns of animal can be fixed to other parts by insertion. In this embodiment, it is as a model of animal's horns to be inserted in and attached to the accessory portion 15.

Figure 1:
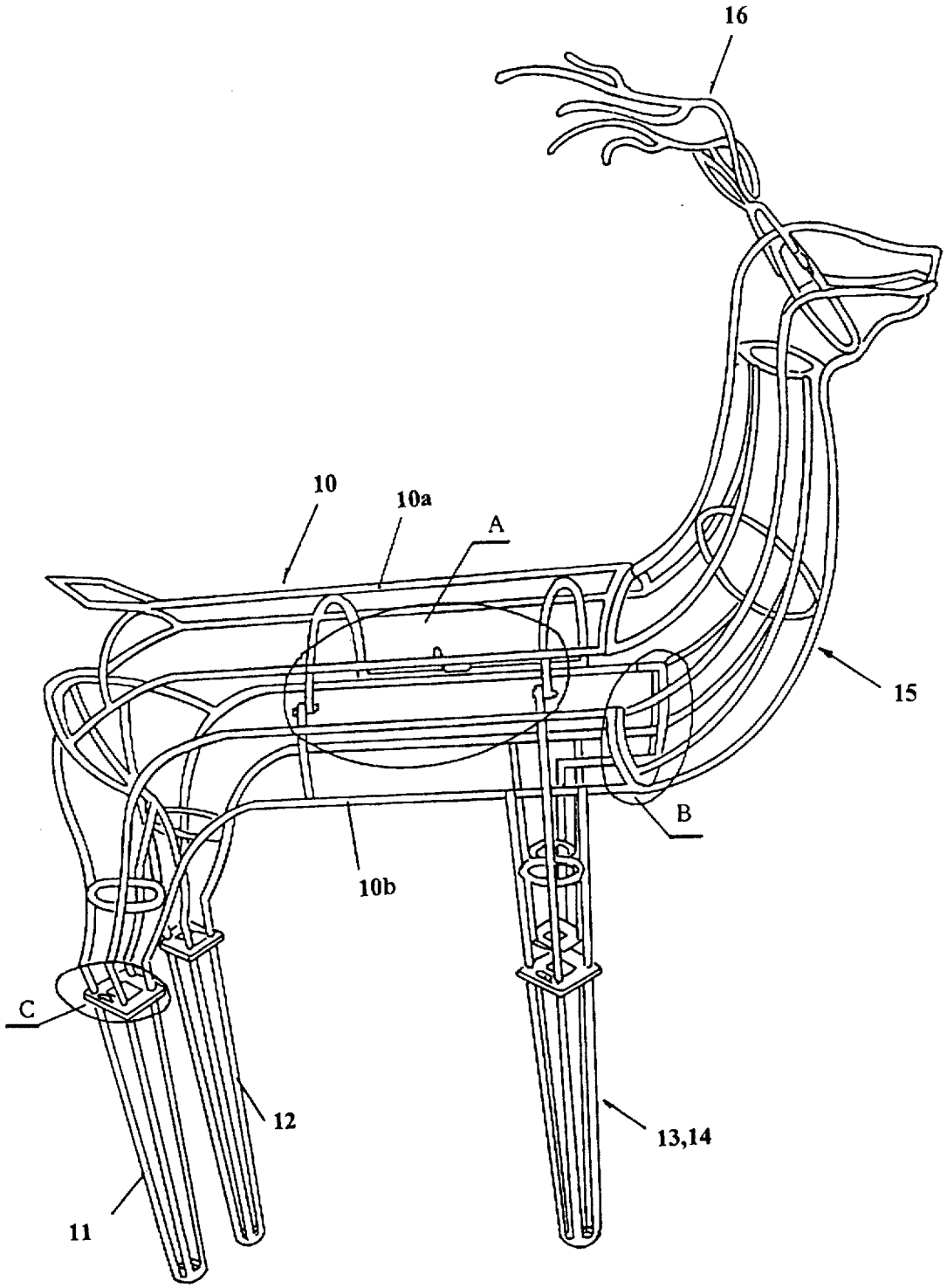
FIG. 1 is a side view showing the structure of an embodiment of a foldable model of the present invention.
Figure 2:
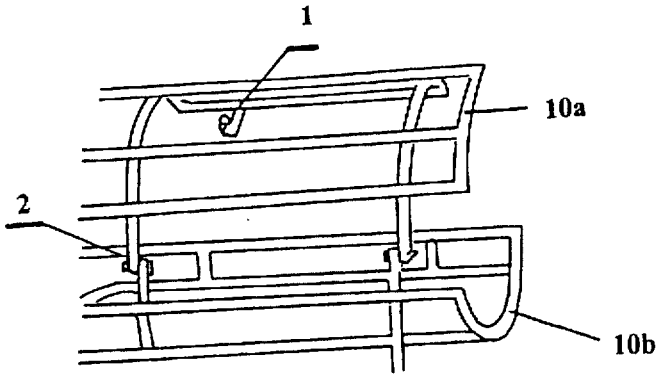
FIG. 2 is a schematic view showing the linking structure of the section A in FIG. 1.
Figure 3:
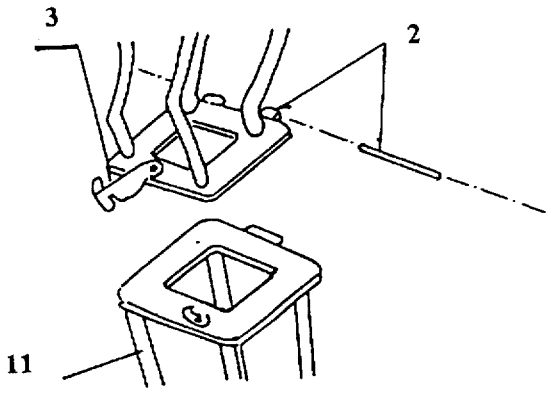
FIG. 3 is a schematic view showing the linking structure of the section C in FIG. 1.
Figure 4:
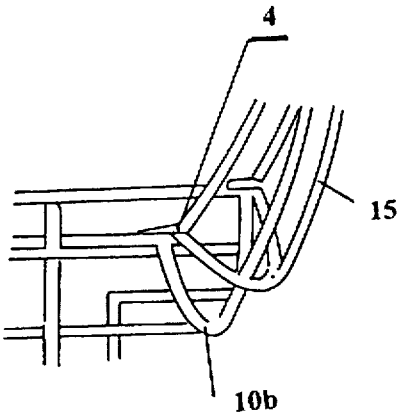
FIG. 4 is a schematic view showing the linking structure of the section B in FIG. 1
Figure 5:
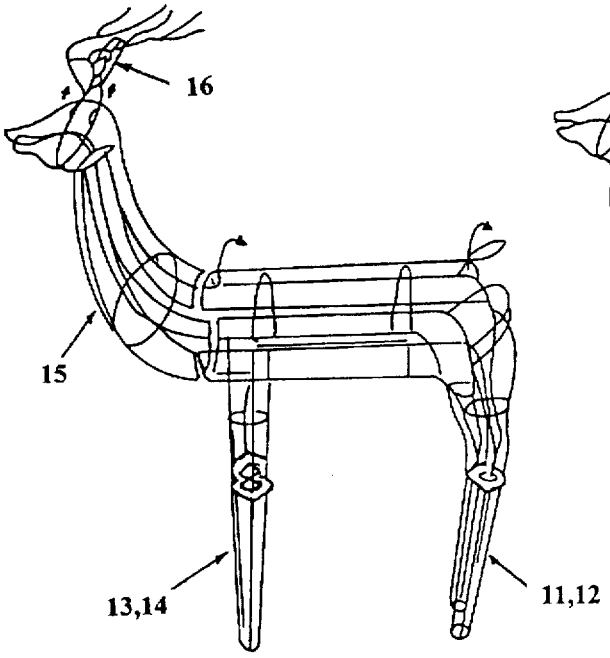
FIGS. 5 to 10 are schematic views showing the folding procedures of the foldable model of the present invention.
Figure 6:
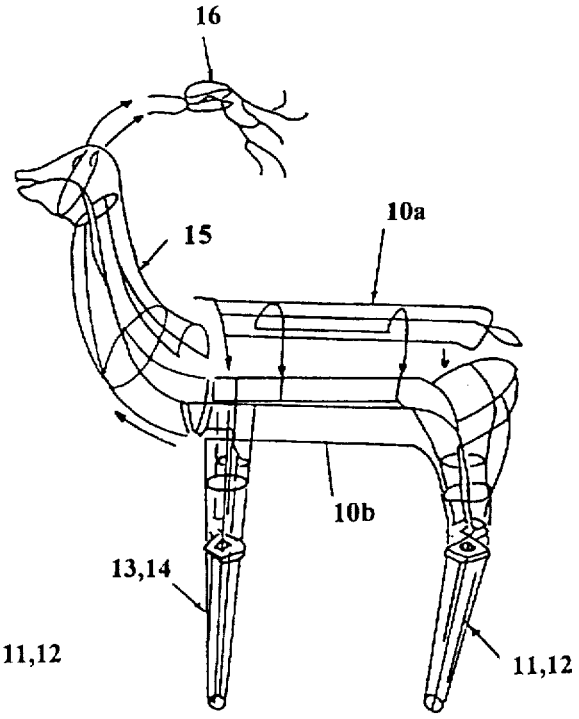
Figure 7:
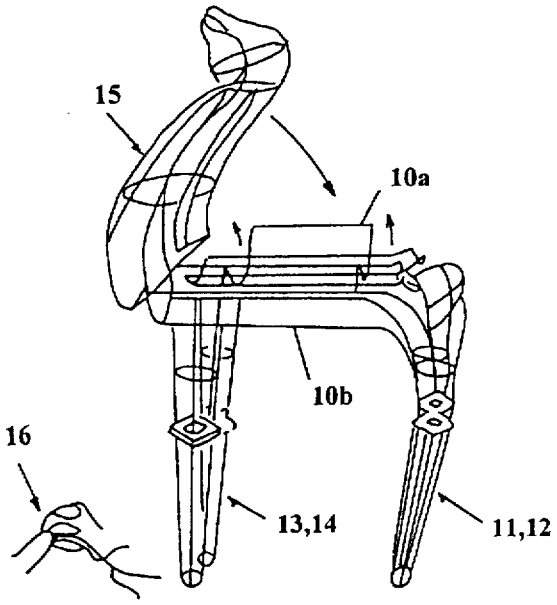
Figure 8:
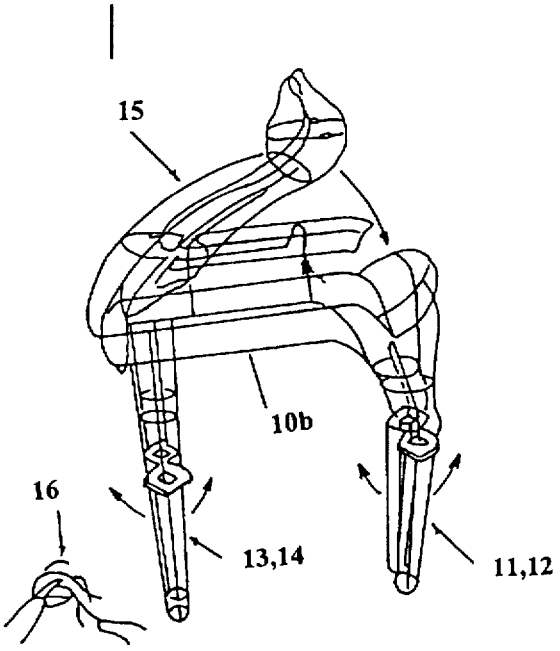
Figure 9:
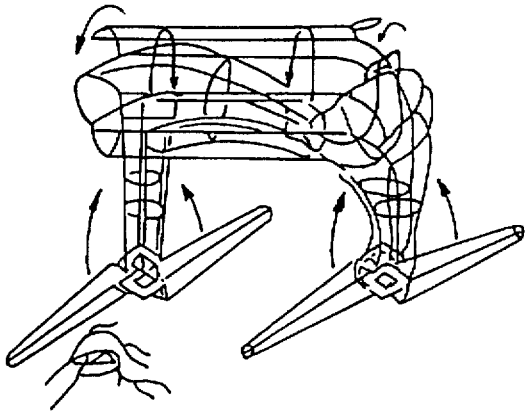
Figure 10:
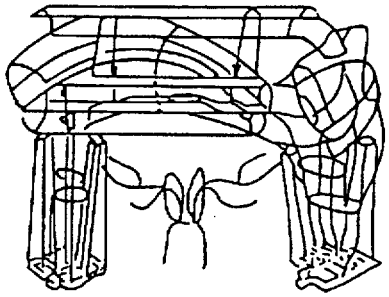

FIG. 5 shows the state in which the upper part of the main body portion of an animal model of this embodiment is about to be lifted open. FIG. 6 shows the state in which the upper part is lifted further open and the ornamental piece, i. e. the animal's horns, is pulled off. FIG. 7 shows the state in which the upper part has already been fully lifted open and the accessory portion 15 is about to be folded into the hollow cavity formed by the wires of the lower part of the main body portion. FIG. 8 shows the state in which the accessory portion 15 is further folded towards the cavity of the lower part and the pivotal fastening latches for the accessory portions 11, 12, 13 and 14 are all released. FIG. 9 shows the state in which the accessory portion 15 is completely folded into the lower part, the upper part is going to return pivotally to its initial position and the accessory portions 11, 12, 13 and 14 are further folded. FIG. 10 shows the state in which the upper part has already entirely overlain on the lower part and the accessory portions 11, 12 13 and 14 has already reached their final folded position, and in the mean time the ornamental piece, in this embodiment, the horns of an animal model, can be placed in any cavity formed in the animal model. After being folded. In this manner, the folding and unfolding process of the foldable model of the present invention is completed.

It can be seen that the foldable animal model according to the present invention after being folded occupies a volume much smaller than that of a prior art animal model of corresponding dimension after being dismantled. The folding process before packing and the unfolding process after transportation are very simple and easy. Therefore, the foldable model of the present invention is not only convenient for transportation but also the relevant costs thereof have evidently been reduced, so that the selling prices of various models can thus be reduced.

Those skilled in the art should understand that though the embodiment of the present invention is a deer, yet the foldable structure of the present invention along with its dismantling and rejoining processes can be applied to various models made out of wire materials.

I claim:

1. A foldable model made out of wire materials through deformation, assembling and welding to form a wire main body portion and several wire accessory portions, characterized in that the joining of the wire of the accessory portions with the wire main body portion are carried out by means of hinges and pivotal fastening latches that are suitable for a wire frame foldable model so that those portions needing to be folded can be folded into or towards said wire main body portion to reduce the overall packing dimension of said model.

2. The foldable model according to claim 1, wherein an ornamental piece can be attached to or detached from said model by insertion.

* * * * *

UNITED STATES PATENT AND TRADEMARK OFFICE

CERTIFICATE OF CORRECTION

PATENT NO. : 5,766,701

DATED : June 16, 1998

INVENTOR(S) : William LEE

It is certified that error appears in the above-indentified patent and that said Letters Patent is hereby corrected as shown below:

On the Title Page, Item 76, line 1, "DongguanKing" should read --Dongguan King--; and line 3, "Ltd.King" should read --Ltd., King--.

In Claim 1, Col. 2, line 65, after "of the wire," delete "of the".

Signed and Sealed this

Twenty-fifth Day of August, 1998

*Attest:*

*Attesting Officer*

BRUCE LEHMAN

*Commissioner of Patents and Trademarks*